United States Patent [19]

Markley et al.

[11] 4,415,441

[45] Nov. 15, 1983

[54] CATALYTIC REFORMING PROCESS

[75] Inventors: Gerald E. Markley; William E. Winter, both of Baton Rouge, La.

[73] Assignee: Exxon Research and Engineering Co., Florham Park, N.J.

[21] Appl. No.: 417,218

[22] Filed: Sep. 13, 1982

[51] Int. Cl.[3] ..... C10G 35/08

[52] U.S. Cl. ..... 208/138; 208/139; 585/951

[58] Field of Search ..... 208/138; 585/951

[56] References Cited

U.S. PATENT DOCUMENTS 3,793,183 2/1974 Mahoney et al. ..... 208/138

4,124,490 11/1978 Collins et al. ..... 208/139

*Primary Examiner*—Curtis R. Davis

*Attorney, Agent, or Firm*—Llewellyn A. Proctor

[57] ABSTRACT

A process for reforming, with hydrogen, a naphtha in a reforming reactor provided with a rhenium promoted platinum catalyst over which the naphtha is contacted and reacted at reforming conditions to produce a $C_5+$ liquid product of improved octane. The catalyst is contacted, on initiation of the reforming reaction, with a maximum of about 75 percent of the rate of hydrogen required for maintaining the optimum $C_5+$ liquid yield over the length of the operating cycle. The hydrogen rate is increased not later than the time of line-out of the $C_5+$ liquid yield to that required to maintain said optimum $C_5+$ liquid yield.

5 Claims, No Drawings

CATALYTIC REFORMING PROCESS

FIELD OF THE INVENTION

This invention relates to a process for the start-up of a reforming unit which contains a rhenium reforming catalyst, especially a rhenium promoted platinum, or polymetallic platinum reforming catalyst.

BACKGROUND OF THE INVENTION AND PRIOR ART

Catalytic reforming, or hydroforming, is a well established industrial process employed by the petroleum industry for improving the octane quality of naphthas or straight run gasolines. In reforming, a multi-functional catalyst is employed which contains a metal hydrogenation-dehydrogenation (hydrogen transfer) component, or components, substantially atomically dispersed upon the surface of a porous, inorganic oxide support, notably alumina. Noble metal catalysts, notably of the platinum type, are currently employed, reforming being defined as the total effect of the molecular changes, or hydrocarbon reactions, produced by dehydrogenation of cyclohexanes and dehydroisomerization of alkylcyclopentanes to yield aromatics; dehydrogenation of paraffins to yield olefins; dehydrocyclization of paraffins and olefins to yield aromatics; isomerization of n-paraffins; isomerization of alkylcycloparaffins to yield cyclohexanes; isomerization of substituted aromatics; and hydrocracking of paraffins which produces gas, and inevitably coke, the latter being deposited on the catalyst.

In a typical process, a series of reactors constitute the heart of the reforming unit. Each reforming reactor is generally provided with fixed beds of catalyst which receive upflow or downflow feed, and each is provided with means for preheating the feed because the reactions which take place are endothermic. A naphtha feed, with hydrogen, or hydrogen recycle gas, is concurrently passed through a preheat furnace and reactor, and then in sequence through subsequent heaters and reactors of the series. The product from the last reactor is separated into a liquid fraction, i.e., a $C_5+$ or $C_5$/430° F. fraction, and a vaporous effluent. The latter is a gas rich in hydrogen which usually contains small amounts of normally gaseous hydrocarbons. Hydrogen is separated from the $C_5+$ liquid product and recycled to the process to minimize coke production, hydrogen being produced in net yield.

Platinum has been widely commercially used in recent years in the production of reforming catalysts, and platinum-on-alumina catalysts have been commercially employed in refineries for the last few decades. In the last decade, polymetallic platinum metal catalysts have been employed to provide, at reforming conditions, improved catalyst activity, selectivity and stability. Thus, one or more additional metallic components have been added to platinum as promotors to further improve, particularly, the activity or selectivity, or both, of the basic platinum catalyst, e.g., iridium, rhenium, palladium, selenium, tin, copper and the like. Platinum-rhenium catalysts, for example, possess superior selectivity for use in reforming operations as compared with platinum catalysts, selectivity being defined as the ability of the catalyst to produce high yields of $C_5+$ liquid products with concurrent low production of normally gaseous hydrocarbons, i.e., methane and other gaseous hydrocarbons, and coke.

Platinum-rhenium catalysts have been staged in the reactors of reforming units in various ways in order to improve the overall activity, or selectivity of the catalyst. For example, in application Ser. Nos. 082,804 and 082,805 by Swan and Oyekan and Swan, respectively, filed Sept. 9, 1978, the lead reactors are charged with low rhenium platinum-rhenium catalysts, or catalysts wherein the atomic ratio of rhenium:platinum is 1:1, or less, and the tail reactor, or last reactor of the reactor series contains a high rhenium, platinum-rhenium catalyst, or catalyst wherein the atomic ratio of rhenium:platinum is at least 1.5:1, and preferably 2:1 and greater. Higher $C_5+$ liquid yield is obtained than in the more conventional use of platinum-rhenium catalysts wherein all of the reactors of a unit contain a low rhenium, platinum-rhenium catalyst; or in accordance with U.K. Patent Application GB No. 2 028 278A wherein all of the reactors of a unit contain a high rhenium, platinum-rhenium catalyst. Pressure has also been found to affect the reforming operations employing such catalysts. At ultra low pressure conditions (e.g., 175 psig, 3000 SCF/B hydrogen recycle) it was found, and disclosed in application Ser. No. 409,073 (OP-2871), filed Aug. 18, 1982, by William E. Winter, Jr. and Gerald E. Markley that both catalyst activity and yield stability were increased even with amounts of high rhenium, platinum-rhenium catalysts greater than disclosed in the Ser. Nos. 082,804 and 082,805 application, supra, distributed throughout the rearwardmost reactors of a reforming unit; even when all of the reactors of the unit were charged with a high rhenium, platinum-rhenium catalyst as disclosed in U.K. Patent Application GB No. 2 018 278A, supra. In fact, in the unit wherein all of the reactors were charged with a high rhenium, platinum-rhenium catalyst the superior yield stability was demonstrated by a $C_5+$ liquid yield credit of 0.8 LV% after 1000 hours on-oil. However, the high cycle average $C_5+$ yields of such system were significantly compromised by a period of excessive cracking experienced at, and near the start of a run. This excessive cracking, a phenomenon known as hydrogenolysis wherein there is excessive gas make and loss of $C_5+$ liquid yield, has commonly been observed at start-of-run conditions with rhenium-containing catalysts. At start-up the production of $C_1$–$C_4$ gases commences, and gradually decreases with concurrent increase in the production of $C_5+$ liquids. Eventually the production of $C_1$–$C_4$ gases levels off and the $C_5+$ liquid yield lines-out which marks the end of the start-up period. Although the cracking phenomenon is usually temporary, it reduces start-of-run yields and adversely impacts on average cycle yields; at least proportionate with the degree and duration of the cracking behavior.

The activity of the catalyst gradually declines due, at least in part, to the build-up of coke. Coke formation is believed to result from cracking and polymerization reactions; perhaps from the deposition of coke precursors such as anthracene, coronene, ovalene and other condensed ring aromatic molecules on the catalyst, these polymerizing to form coke. During operation, the temperature of the process is gradually raised to compensate for the activity loss caused by coke deposition. Eventually, however, economics dictates the necessity of reactivating the catalyst. Consequently, in all processes of this type the catalyst must necessarily be periodically regenerated by removal of the coke from the catalyst. Typically, in the regeneration, the coke is burned from the catalyst at controlled conditions. In a regeneration of this type, the coked catalyst is contacted with oxygen at flame front temperatures ranging about 800° F. to about 1050° F., this being generally followed by a secondary burn with increased oxygen concentrations as coke is depleted from the catalyst.

Two major types of reforming are generally practiced in the multi reactor units, both of which necessitate periodic reactivation of the catalyst, the initial sequence of which requires regeneration, i.e., burning the coke from the catalyst. Reactivation of the catalyst is then completed in a sequence of steps wherein the agglomerated metal hydrogenation-dehydrogenation components are atomically redispersed. In the semi-regenerative process, a process of the first type, the entire unit is operated by gradually and progressively increasing the temperature to maintain the activity of the catalyst caused by the coke deposition, until finally the entire unit is shut down for regeneration, and reactivation, of the catalyst. In the second, or cyclic type of process, the reactors are individually isolated, or in effect swung out of line by various manifolding arrangements, motor operated valving and the like. The catalyst is regenerated to remove the coke deposits, and then reactivated while the other reactors of the series remain on stream. A "swing reactor" temporarily replaces a reactor which is removed from the series for regeneration and reactivation of the catalyst, until it is put back in series.

THE INVENTION

It is the primary objective of the present invention to provide a novel process for the start-up of rhenium catalyst-containing reforming reactors, or unit containing one or more rhenium catalyst-containing reactors; particularly one or a series of reactors which contain rhenium promoted platinum catalysts, or platinum catalysts to which rhenium or rhenium and one or more other additional metal components have been added.

This and other objects are achieved in accordance with this invention embodying a process wherein naphtha is reformed over a fresh or regenerated rhenium-containing catalyst by contact, on initiation of the reforming reaction at reforming conditions, with hydrogen or hydrogen-containing gas, notably hydrogen recycle gas, at a maximum of about 75 percent of the rate of hydrogen required for maintaining the optimum $C_5+$ liquid yield over the length of the operating cycle, and thereafter, not later than the time of line-out of the $C_5+$ liquid yield, increasing the hydrogen rate to that required to maintain said optimum $C_5+$ liquid yield. The gas rate on initiation of the start-up period is generally maintained within a range of from about 20 percent to about 75 percent, and is preferably maintained at from about 40 percent to about 60 percent of the hydrogen gas rate of the post start-up period, and contact with the catalyst continued at said low rate until just before or at the end of the start-of-run period which is manifested by line-out of the $C_5+$ liquid yield. At the end of the start-of-run period the hydrogen gas rate is then increased to at least 33 percent above the rate employed during the start-up period, and preferably increased from about 150 percent to about 70 percent above the rate employed during the start-up period.

For example, in initiating a start-up in a reforming unit which normally operates at 6000 SCF/B in accordance with this invention, hydrogen gas is introduced, or recycled into a reactor at a rate not exceeding about 4500 SCF/B of hydrogen recycle gas, and preferably at a rate of from about 2400 SCF/B to about 3600 SCF/B, and just before or at the end of the start-up period hydrogen recycle gas is introduced into a reactor at a rate of at least about 6000 SCF/B.

The reason for the effectiveness of the low recycle hydrogen gas start-up in suppressing excessive start-of-run hydrocracking is not entirely understood, but it is believed that there is an initial rapid coke laydown on the catalyst which results in passivation of the hydrogenolysis activity of the catalyst at a greater rate than the aromatization activity of the catalyst is suppressed. Although it was found that the low recycle hydrogen gas rate does result in increased catalyst deactivation, the overall loss of catalyst activity properly controlled can be far less innocuous than the corresponding loss in $C_5+$ liquid yield during the start-up period. Accordingly, a low recycle hydrogen gas treat is applied to the fresh or regenerated, reactivated catalyst, and then the recycle hydrogen rate is increased just before, or at least by the time that $C_5+$ liquid yield peaks and begins to line-out to minimize catalyst deactivation. The suppression of $C_5+$ liquid yield loss is particularly manifest in the use of the low recycle hydrogen gas treat during start-up of the high rhenium, platinum-rhenium catalysts. Thus, a brief operation with these catalysts at reduced gas rates not only improves start-of-run yields, but also improves operation at higher gas rates.

The following examples and comparative demonstrations are simulations of a commercial operation and exemplary of the present invention.

EXAMPLES

In conducting the runs exemplified hereafter a naphtha feedstock having the inspections given in Table I was employed.

TABLE I

| | |
|---|---|
| ASTM Distillation, °F. | |
| Initial | 181 |
| 10 | 204 |
| 20 | 211 |
| 30 | 218 |
| 40 | 229 |
| 50 | 241 |
| 60 | 253 |
| 70 | 269 |
| 80 | 287 |
| 90 | 310 |
| Final B.P. | 350 |
| Gravity, °API | 59.7 |
| Sulfur, Wt. ppm | 0.5 |
| Analysis, Vol. Percent | |
| Paraffins | 58.1 |
| Naphthenes | 32.1 |
| Aromatics | 9.3 |

A high rhenium, Pt-Re catalyst (0.3 wt.% Pt; 0.67 wt.% Re) and a low rhenium, Pt-Re catalyst (0.3 wt% Pt; 0.3 wt.% Re) were used to reform the naphtha at the conditions specified to produce a target 99 RONC product over a period of 400 hours, reference being made to Table II.

In the first of a series of tests a reactor was charged with the high rhenium, platinum-rhenium catalyst, and 3000 SCF/B of hydrogen with naphtha was contacted over the catalyst for a period ranging to 400 hours, this time period ending the start-of-run period as manifested by the peaking and leveling off of the $C_5+$ liquid yield. For comparative purposes, a second identical run was made except that 1500 SCF/B of hydrogen was charged into the reactor.

In a thrid run, 3000 SCF/B of hydrogen was contacted with the naphtha at similar conditions except that the bottom of the reactor contained 67 wt.% of the total charge as a high rhenium, platinum-rhenium catalyst and the upper part of the reactor contained 33 wt.% of the total catalyst charge as a low rhenium, platinum-rhenium catalyst.

TABLE II $C_5$ + LV% YIELDS FOR PLATINUM-RHENIUM CATALYSTS

On-oil Run: Start-of-Run 885° F. (E.I.T.); End-of-Run 960° F. (E.I.T.), 146 psig and W/H/W Sufficient to Produce 99 RONC Product

| Hours On Oil | All Hi Re, Pt—Re Catalyst Base Run 3000 SCF/B Start-up | All Hi Re, Pt—Re Catalyst Low Recycle Pt—Re Catalyst Start-up 1500 SCF/B | 33% Low Re Pt—Re Catalyst 67% Hi Re, 3000 SCF/B Start-up |
|---|---|---|---|
| 50 | 74.2 | 76.3 | 75.1 |
| 100 | 74.5 | 76.3 | 75.7 |
| 200 | 75.3 | 76.2 | 76.2 |
| 400 | 76.6 | 76.3 | 76.4 |

These data show that operation at the low gas rate resulted in a $C_5$+ liquid yield of 76.3 LV% yield at 50 hours on oil vs. 74.2 LV% yield for the base run at 50 hours. 400 hours of on-oil operation were required for the base run yields to line-out at 76.6 LV%, whereas comparable $C_5$+ liquid yields were attained at the low recycle start-up conditions after only 50 hours of operation. After 120 hours on oil, the gas rate of the latter run was increased from 1500 SCF/B to 3000 SCF/B. Following this increase, no reduction in $C_5$+ liquid yield was observed, indicating that only a brief exposure to severe low treat gas conditions permanently suppressed the fresh high rhenium, platinum-rhenium catalyst cracking behavior.

Catalyst useful in accordance with this invention are platinum-rhenium catalysts further modified, if desired, by the addition of other metals. The platinum, rhenium and other promoters are each added to the catalyst in concentration ranging from about 0.01 to about 3 percent, preferably from about 0.2 to about 1 percent, based on the weight of the catalyst.

The metal hydrogenation components can be composited or intimately associated with the porous inorganic oxide support or carrier by various techniques known to the art such as ion-exchange, coprecipitation with the alumina in the sol or gel form, and the like. For example, the catalyst composite can be formed by adding together suitable reagents such as salts of platinum and rhenium, and ammonium hydroxide or ammonium carbonate, and a salt of aluminum such as aluminum chloride or aluminum sulfate to form aluminum hydroxide. The aluminum hydroxide containing the salts of platinum and rhenium can then be heated, dried, formed into pills, pellets, tablets, or the like or extruded, and then calcined. The metal components can also be added to the catalyst by impregnation, typically via an "incipient wetness" technique which requires a minimum of solution so that the total solution is absorbed, initialy or after some evaporation.

It is generally preferred, however, to deposit the platinum and rhenium metals, and other metals used as promoters, on a previously pilled, pelleted, beaded, extruded, or sieved particulate support material by the impregnation method. Pursuant to the impregnation method, porous refractory inorganic oxides in dry or solvated state are contacted, either alone or admixed, or otherwise incorporated with a metal or metals-containing solution, or solutions, and thereby impregnated by either the "incipient wetness" technique, or a technique embodying absorption from a dilute or concentrated solution, or solutions, with subsequent filtration or evaporation to effect total uptake of the metallic components.

The impregnation solutions of the noble metal compound, and metals or other compounds used as promoters, are prepared by dissolving the compounds, or salts, in water or any other inorganic or organic solvents. The concentration of the metallic components can range from about 0.01 to 5 percent, preferably from about 0.05 to 1 percent, based on the weight of solution. The pH of the impregnation solution should be controlled to less than about 4, preferably less than 3, by the addition of a suitable inorganic or organic acid. By controlling the pH within these ranges, the components can be effectively dispersed into the inner part of the catalyst. Generally, it is preferred to use a halogen-acid aqueous solution of the noble metals.

To enhance catalyst performance, halogen component is added. Fluorine and chlorine are perferred halogen components. The halogen is contained on the catalyst within the range of 0.1 to 3 percent, preferably within the range of about 0.3 to 2 percent, based on the weight of the catalyst. When using chlorine as a halogen component, it is contained on the catalyst within the range of about 0.2 to 2 percent, preferably within the range of about 0.5 to 1.5 percent; based on the weight of the catalyst. The introduction of halogen into catalyst can be carried out by any method and at any time of the catalyst preparation, for example, prior to, following or simultaneously with the impregnation of the platinum and rhenium components. In the usual operation, the halogen component is introduced simultaneously with the incorporation of the platinum metal component. It can also be introduced by contacting a carrier material in a vapor phase or liquid phase with a halogen compound such as hydrogen fluoride, hydrogen chloride, ammonium chloride, or the like.

The catalyst is dried by heating at a temperature above about 80° F., preferably between about 105° F. and 300° F., in the presence of nitrogen or oxygen, or both, in an air stream or under vacuum.

The feed or charge stock can be a virgin naphtha, cracked naphtha, a Fischer-Tropsch naphtha, or the like. Typical feeds are those hydrocarbons containing from about 5 to 12 carbon atoms, or more preferably from about 6 to about 9 carbon atoms. Naphthas, or petroleum fractions boiling within the range of from about 80° F. to about 450° F., and preferably from about 125° F. to about 375° F., contain hydrocarbons of carbon numbers within these ranges. Typical fractions thus usually contain from about 20 to about 80 vol.% paraffins, both normal and branched, which fall in the range of about $C_5$ to $C_{12}$, from about 10 to 80 vol.% of naphthenes falling within the range of from about $C_6$ to $C_{12}$, and from 5 though 20 vol.% of the desirable aromatics falling within the range of from about $C_6$ to $C_{12}$.

The reforming runs are initiated by adjusting the hydrogen and feed rates, and the temperature and pressure to operating conditions. After start-up at low hydrogen rate, a run is continued at optimum reforming conditions by adjustment of the major process variables, within the ranges described below.

| Major Operating Variables | Typical Process Conditions | Preferred Process Conditions |
|---|---|---|
| Pressure, Psig | 50–750 | 100–300 |
| Reactor Temp., °F. | 750–1100 | 850–1000 |
| Gas Rate, SCF/B (Incl. Recycle Gas) | 1500–10,000 | 2000–7000 |
| Feed Rate, W/W/Hr. | 0.5–10 | 1–3 |

It is apparent that the process of this invention is subject to some modification and variations without departing its spirit and scope.

Having described the invention, what is claimed is:

1. In a process for reforming, with hydrogen, a naphtha in a reforming reactor provided with a rhenium promoted platinum catalyst over which the naphtha is contacted and reacted at reforming conditions to produce a $C_5+$ liquid product of improved octane, the improvement comprising contacting said catalyst on initiation of the reforming reaction at a maximum rate of about 75 percent of the hydrogen required for maintaining the optimum $C_5+$ liquid yield over the length of the operating cycle, and thereafter increasing the hydrogen rate to that required to maintain said optimum $C_5+$ liquid yield not later than the time of line-out of the $C_5+$ liquid yield.

2. The process of claim 1 wherein at start-up the hydrogen is introduced into the reactor at a maximum rate of about 4500 SCF/Bbl.

3. The process of claim 1 wherein at start-up the hydrogen is introduced into the reactor at a rate of from about 40 percent to about 60 percent of the rate of hydrogen required for maintaining the optimum $C_5+$ liquid yield over the length of the operating cycle.

4. The process of claim 1 wherein the catalyst contains an atomic ratio of rhenium:platinum of 1.5:1, or greater.

5. The process of claim 4 wherein the catalyst contains an atomic ratio of rhenium:platinum of 2:1, or greater.

* * * * *